United States Patent [19]

Wahl et al.

[11] Patent Number: 5,065,927

[45] Date of Patent: Nov. 19, 1991

[54] APPARATUS FOR EVENLY DISPENSING MELTED BUTTER

[76] Inventors: Seymour Wahl, 67 Prospect Ave., Hewlett, N.Y. 11557; George Spector, 233 Broadway RM 3815, New York, N.Y. 10007

[21] Appl. No.: 328,903

[22] Filed: Mar. 27, 1989

[51] Int. Cl.[5] ..... B65B 1/04

[52] U.S. Cl. ..... 222/185; 141/356; 222/482; 99/323.8

[58] Field of Search ..... 222/514, 509, 518, 372, 222/185, 482; 239/518, 519, 520, 567; 99/323.5, 323.8; 141/351-354, 356

[56] References Cited

U.S. PATENT DOCUMENTS

| | | | |
|---|---|---|---|
| 1,182,452 | 5/1916 | Bucklin | 222/514 |
| 1,286,460 | 12/1918 | Wellborn | 239/567 |
| 1,526,101 | 2/1925 | Sund | 222/509 |
| 1,788,779 | 1/1931 | Regester | 239/520 |
| 2,221,113 | 11/1940 | Schmidt | 239/567 |
| 2,345,808 | 4/1944 | Green | 239/567 |
| 2,593,634 | 4/1952 | Vosburg | 222/514 |
| 2,641,270 | 6/1953 | Allen | 239/567 |
| 2,870,944 | 1/1959 | Campbell | 222/509 |
| 2,874,734 | 2/1959 | Luckock et al. | 141/356 X |
| 3,765,577 | 10/1973 | Burns, Jr. | 222/509 |

FOREIGN PATENT DOCUMENTS

| | | | |
|---|---|---|---|
| 116410 | 1/1943 | Australia | 141/356 |
| 253341 | 11/1960 | Australia | 222/509 |
| 821487 | 7/1949 | Fed. Rep. of Germany | 239/518 |

*Primary Examiner*—Michael S. Huppert

[57] ABSTRACT

An apparatus for dispensing melted butter into a container of popcorn is provided having a mechanism in which the melted butter will be sprayed evenly throughout the popcorn.

2 Claims, 1 Drawing Sheet

10
24
12
22
18
20
26
32
33
2
28
14
4
16
56
30
10a
24a
68
70
66
64
58
60
62
22a

APPARATUS FOR EVENLY DISPENSING MELTED BUTTER

BACKGROUND OF THE INVENTION

The instant invention relates generally to devices for dispensing liquids and more specifically it relates to an apparatus for dispensing melted butter into a container of popcorn.

Numerous devices for dispensing liquids have been provided in prior art that are adapted to apply the liquids to various foods such as popcorn, sausage and the like. For exmaple, U.S. Pat. Nos. 2,811,844; 3,326,530 and 3,774,523 all are illustrative of such prior art. While these units may be suitable for the particular purpose to which they address, they would not be as suitable for the purposes of the present invention as heretofore described.

SUMMARY OF THE INVENTION

A primary object of the present invention is to provide an apparatus for dispensing melted butter into a container of popcorn, that will overcome the shortcomings of the prior art devices.

Another object is to provide an apparatus for dispensing melted butter into a container of popcorn in which the melted butter will be ejected evenly throughout the popcorn.

An additional object is to provide an apparatus for dispensing melted butter into a container of popcorn in which the amount of melted butter can be properly measured when operating the apparatus.

A further object is to provide an apparatus for dispensing melted butter into a container of popcorn that is simple and easy to use.

A still further object is to provide an apparatus for dispensing melted butter into a container of popcorn that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4, 5:
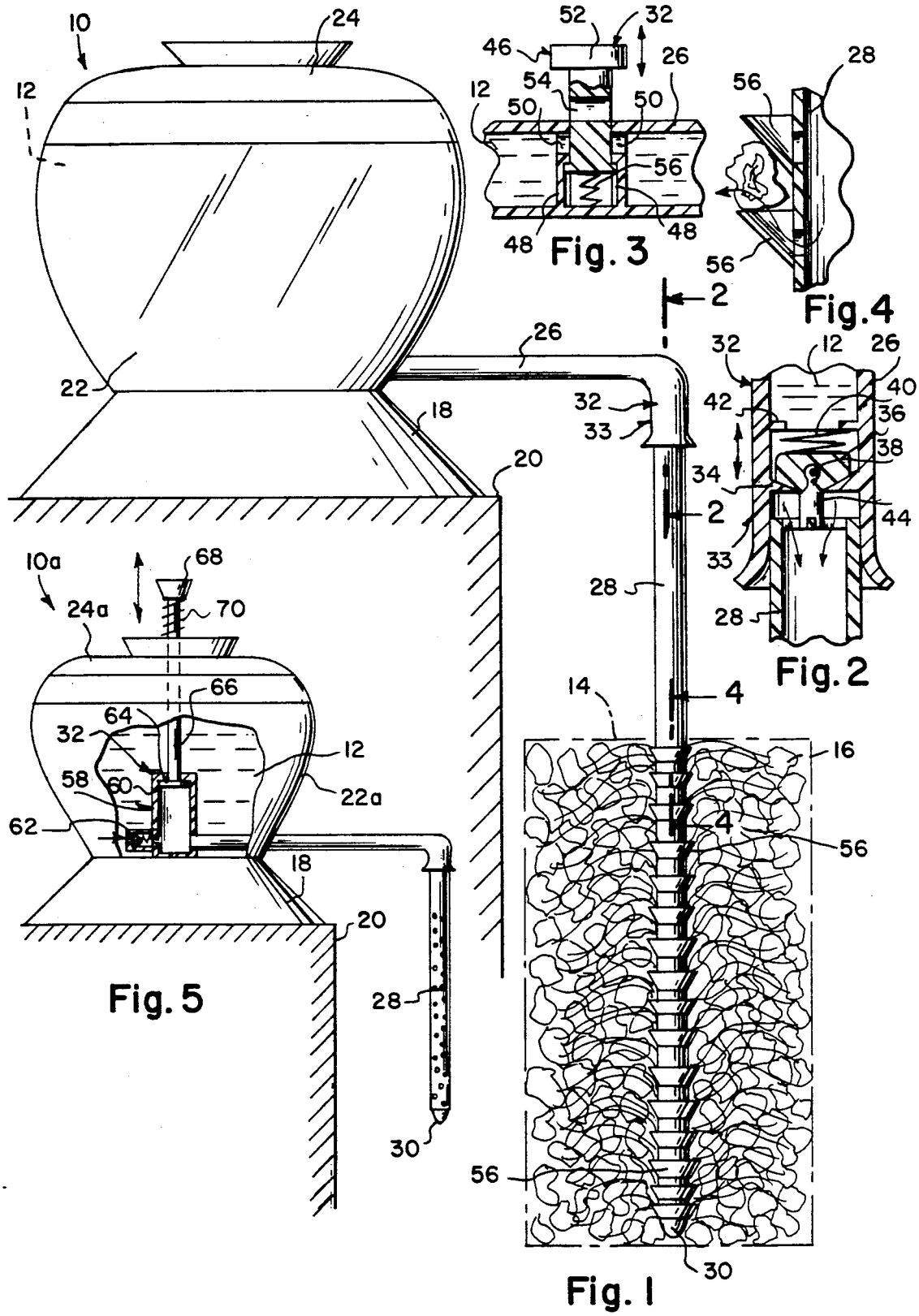
FIG. 1 is a side view of the invention.
FIG. 2 is an enlarged cross sectional view taken along line 2—2 in FIG. 1, showing a pressure controlled check valve actuated by the tube when the popcorn container is pushed up against tip of the tube.
FIG. 3 is a cross sectional view of a push button valve in the spout.
FIG. 4 is a cross sectional view taken along line 4—4 in FIG. 1 with parts broken away to show the deflector shields in greater detail.
FIG. 5 is a side view partly in section of a modification showing a pressure pump within the receptacle.

Turning now descriptively to the drawings, in which similar reference characters denote similar elements throughout the several views, FIG. 1 illustrates an apparatus 10 for dispensing melted butter 12 into a container 14 of popcorn 16. The apparatus 10 consists of a base 18 adapted to be rested on a supporting surface 20, such as a counter or the like. A receptacle 22 associated with the base 18 is for holding the melted butter 12 therein while a cover 24 fits over the receptacle 22. A spout 26 extends from the receptacle 22 and an elongated hollow perforated tube 28 extends from the spout 26. The tube 28 has a pointed tip 30 so as to go through the popcorn 16 in the container 14. A mechanism 32 is provided for releasing the melted butter 12 so as to be ejected evenly throughout the popcorn 16 from the perforated tube 28.

As best seen in FIG. 2, the mechanism 32 is a pressure controlled check valve 33 that includes a seat 34 formed within end of the spout 26. A poppet 36 that has a socket 38 is carried within the valve 33. A spring 40 is held within the valve 33 by flange 42, to hold the poppet 36 against the seat 34. A ball member 44 on distal end of the tube 28 is engagable with the socket 38 in the poppet 36. The ball member 44 is sized to allow the melted butter 12 to pass therethrough when the tube 28 is pressed upwardly by the container 14 up against the tip 30 of the tube 28 thereby raising the poppet 36 from the seat 34.

Another type of mechanism 32 is shown in FIG. 3, being a push button valve 46 that includes a slide partition 48, disposed transversely within the spout 26. The slide partition 48 has an aperture 50 therethrough. A push button 52 is slideable within the slide partition 48 and the push button 52 has an aperture 54 therethrough. A spring 56 is disposed within the slide partition 48 to bear against bottom of the push button 52 to normally keep the push button in a closed position. When the push button 52 is depressed into an open position the aperture 54 of the push button will be in alignment with the aperture 50 in the slide partition 48 to allow the melted butter 12 to pass therethrough.

As best seen in FIG. 4, a plurality of deflector shields 56 are carried on the perforated tube 28 so as to keep the popcorn 16 from blocking the melted butter 12 that is deflected therefrom.

FIG. 5 shows a modified apparatus 10*a* wherein the mechanism 32 is a pressure pump 58 consisting of a housing 60 carried on bottom of the receptacle 22*a* and fluidly connected to the spout 26*a*. A ball check inlet valve 62 is fluidly connected to the housing 60. A piston 64 is provided and has an elongated arm 66 with an enlarged knob 68 at distal end. The piston 64 is slideable within the housing 60 with the arm 66 extending upwardly through the cover 24*a*. A spring 70 is carried on the arm 66 between the enlarged knob 68 and the cover 24*a* to normally bias the piston 64 to top of the housing 60. When the knob 68 is depressed the pump 58 will allow the melted butter 12 to pass therethrough.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An apparatus for dispensing melted butter into a container of popcorn which comprises:

(a) a base adapted to be rested on a supporting surface;

(b) a receptacle associated with said base for holding melted butter therein;

(c) a cover fitting over said receptacle;

(d) a spout extending laterally from said receptacle;

(e) an elongated hollow perforated tube extending from said spout, said tube having a tip so as to go through the popcorn in the container;

(f) means for releasing the melted butter so as to be ejected evenly throughout the popcorn from said perforated tube; wherein said releasing means is a pressure controlled check valve that includes;

(g) a seat formed within an end of said spout;

(h) a poppet having a socket and carried within said valve;

(i) a spring held within said spout to hold said poppet against said seat; and (j) a ball member on a distal end of said tube engagable with said socket in said poppet, said ball member sized to allow the melted butter to pass therethrough when said tube is pressed upwardly by the container up against tip of said tube, thereby raising said poppet from said seat.

2. An apparatus as recited in claim 1, further comprising a plurality of deflector shields carried on said perforated tube so as to keep the popcorn from blocking the melted butter that is deflected therefrom.

* * * * *